US011339345B2

(12) United States Patent
Gatto et al.

(10) Patent No.: US 11,339,345 B2
(45) Date of Patent: May 24, 2022

(54) LIQUID OCTYLATED PHENYL-α-NAPHTHYLAMINE COMPOSITION

(71) Applicant: VANDERBILT CHEMICALS, LLC, Norwalk, CT (US)

(72) Inventors: Vincent J. Gatto, Bradenton, FL (US); Shubhada Dantale, Norwalk, CT (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 0 days.

(21) Appl. No.: 17/183,916

(22) Filed: Feb. 24, 2021

(65) Prior Publication Data

US 2021/0269733 A1 Sep. 2, 2021

Related U.S. Application Data

(60) Provisional application No. 63/042,765, filed on Jun. 23, 2020, provisional application No. 62/982,803, filed on Feb. 28, 2020.

(51) Int. Cl.

| | |
|---|---|
| ***C10M 141/06*** | (2006.01) |
| ***C10M 169/04*** | (2006.01) |
| ***C10M 133/12*** | (2006.01) |
| ***C10M 129/70*** | (2006.01) |
| ***C10M 129/72*** | (2006.01) |

(52) U.S. Cl.

CPC ..... *C10M 141/06* (2013.01); *C10M 129/70* (2013.01); *C10M 129/72* (2013.01); *C10M 133/12* (2013.01); *C10M 169/04* (2013.01); *C10M 2203/003* (2013.01); *C10M 2207/284* (2013.01); *C10M 2207/285* (2013.01); *C10M 2215/26* (2013.01)

(58) Field of Classification Search

CPC ..... C10M 2207/28; C10M 2207/289; C10M 2215/064; C10M 141/06; C10M 2207/284; C10M 2215/223; C10N 2030/10

See application file for complete search history.

(56) References Cited

U.S. PATENT DOCUMENTS

| | | | | |
|---|---|---|---|---|
| 3,414,618 | A | 12/1968 | Randell | |
| 5,726,135 | A | 3/1998 | Khorramian | |
| 6,326,336 | B1 | 12/2001 | Gatto et al. | |
| 6,726,855 | B1 * | 4/2004 | Migdal | C10M 161/00 252/401 |
| 8,227,391 | B2 | 7/2012 | Ryan et al. | |
| 9,783,759 | B2 | 10/2017 | Yao et al. | |
| 2007/0298984 | A1 * | 12/2007 | Konzman | C10M 169/045 508/303 |
| 2010/0099589 | A1 | 4/2010 | Ryan et al. | |

(Continued)

FOREIGN PATENT DOCUMENTS

| | | |
|---|---|---|
| GB | 1046353 | 10/1966 |
| GB | 2384245 | 7/2003 |

*Primary Examiner* — Vishal V Vasisth

(74) *Attorney, Agent, or Firm* — Norris McLaughlin, P.A.

(57) ABSTRACT

A liquid blend of octylated phenyl-α-naphthylamine, and at least one low molecular weight aromatic ester, wherein the octylated phenyl-α-naphthylamine is present from about 15% to about 35% by weight of the blend, as well as a lubricating composition comprising a lubricant base and an amount of the blend which provides up to 2.0% by weight of the octylated phenyl-α-naphthylamine in the composition.

6 Claims, 6 Drawing Sheets

(56) References Cited

U.S. PATENT DOCUMENTS

| | | | | |
|---|---|---|---|---|
| 2011/0124538 | A1 | 5/2011 | Karseboom et al. | |
| 2013/0252863 | A1 | 9/2013 | Cooper et al. | |
| 2014/0045736 | A1 | 2/2014 | Crawley et al. | |
| 2015/0057203 | A1* | 2/2015 | Tsubouchi ..... | C10M 111/04<br>508/482 |
| 2016/0083671 | A1 | 3/2016 | Yao et al. | |

* cited by examiner

LIQUID OCTYLATED PHENYL-α-NAPHTHYLAMINE COMPOSITION

This application claims benefit of 62/982,803 filed Feb. 28, 2020 and claims benefit of 63/042,765 filed Jun. 23, 2020.

BACKGROUND OF THE INVENTION

Field of the Invention

The invention relates to an antioxidant additive for lubricants, more particularly (1,1,3,3-tetramethylbutyl)-N-phenyl-1-naphthylamine (chemical abstract service number 68259-36-9), or alkylated phenyl-α-naphthylamine (APANA), preferably octylated N-phenyl-α-naphthylamine. The APANA is blended with a liquid aromatic ester to provide a stable, liquid form of APANA that provides improved handling qualities. The invention also relates to a lubricant composition comprising a lubricant base and the blend of APANA and aromatic ester.

APANA is a highly effective antioxidant with applications in a wide range of lubricants including aviation turbine oils, gas turbine oils, compressor oils, hydraulic fluids and engine oils. Examples describing the use of octylated phenyl-α-naphthylamine in lubricants are wide spread, and can be found in U.S. Pat. Nos. 5,726,135, 6,326,336, 8,227,391, 9,783,759, US patent applications 2010/0099589, 2013/0252863, 2014/0045736, 2016/0083671 and UK patent 2384245. Its use, however, has been limited because of difficulty that lubricant blending facilities have in handling the product. The main issue is that APANA must be handled as a powder. This creates a number of complications, the most important of which are the increased cost associated with handling a solid and worker health risks caused by dust exposure from the solid. Melting the solid is not practical due to its high melting point. Therefore, there is a need in the industry to provide APANA in a liquid form for improved handling.

Discussion of the Prior Art

Octylated N-phenyl-α-naphthylamine may be prepared in a number of different ways. Examples of its preparation can be found in UK patent 1046353, U.S. Pat. No. 3,414,618, and US patent application 2011/0124538 A1. These methods of preparation all involve isolating the product as a solid.

Numerous attempts have been made to dilute APANA as a fluid that could allow delivery of the solid product in a liquid form. This would eliminate the exposure of certain workers to the solid and reduce manufacturing costs in blending facilities. Attempts have been made to dissolve APANA in mineral oils, poly-α-olefins, polyols and polyol esters with no success. Typically, less than 1% APANA can be dissolved in these common base fluids. This is not a practical level for applying the additive to an additive package, additive package concentrate or finished fluid. A practical level would be 15 wt. % or more of the APANA in a suitable solubilizing fluid. Thus far, such a suitable fluid has not been identified.

SUMMARY OF THE INVENTION

It has been found that APANA, preferably octylated N-phenyl-α-naphthylamine, can be solubilized, quite effectively, in low molecular weight aromatic esters (150-350 MW) at levels as high as about 35%, and that the compositions are stable with no signs of solid fall out or crystallization on prolonged storage under ambient (room temperature 20 degrees C.) conditions. Higher concentrations of APANA (up to about 50 wt %) may be solubilized in these aromatic esters with gentle heating (50 to 60 deg C.). Aromatic esters that may be used include phthalate esters, isophthalate esters, terephthalate esters, trimellitate esters, and benzoate esters. Examples of specific aromatic esters that may be used include tris-methyl trimellitate, tris-ethyl trimellitate, tris-propyl trimellitate, tris-butyl trimellitate, tris-2-ethylhexyl trimellitate, tris-isooctyl trimellitate, tris-2-ethylhexyl trimellitate, tris-n-octyl trimellitate, tris-isononyl trimellitate, tris-isodecyl trimellitate, diethyl phthalate, dipropyl phthalate, dibutyl phthalate, di-2-ethylhexyl phthalate, diisooctyl phthalate, di-n-octyl phthalate, diisononyl phthalate, diisodecyl phthalate, diethyl isophthalate, dipropyl isophthalate, dibutyl isophthalate, di-2-ethylhexyl isophthalate, diisooctyl isophthalate, di-n-octyl isophthalate, diisononyl isophthalate, diisodecyl isophthalate, diethyl terephthalate, dipropyl terephthalate, dibutyl terephthalate, di-2-ethylhexyl terephthalate, diisooctyl terephthalate, di-n-octyl terephthalate, diisononyl terephthalate, diisodecyl terephthalate, 2-ethylhexyl benzoate, isooctyl benzoate, n-octyl benzoate, isodecyl benzoate and benzyl benzoate. Preferably, methyl trans-cinnamate, diethyl phthalate and/or benzyl benzoate are used as the diluent. One or multiple aromatic esters may be used, such as a combination of diethyl phthalate and benzyl benzoate at a ratio of about 2:1 to about 1:2 by weight, preferably about 1:1. It is preferred that the closed cup flash point of the aromatic ester is above 93.4 deg C. It is also preferred that the molecular weight of the aromatic ester is above 150 amu, and the boiling point is above 300 deg C. at 760 mm Hg.

A liquid blend of APANA composed of one or more aromatic esters may be prepared by mixing the solid APANA with one or more liquid aromatic esters at between room temperature (20 deg. C.) and 60 deg C. The order of addition is not critical. The blend may also be prepared as part of the manufacturing process for production of solid APANA where the aromatic ester is added at a point in the process that avoids producing the solid product. This is advantageous because it would save considerable cost associated with isolating a solid product, such as avoiding solvents, a crystallization step and a filtration step.

A liquid blend of APANA composed of one or more aromatic esters may be added to a finished lubricant, a lubricant additive concentrate or lubricant additive package at room temperature or with gentle heating. Typically, heating is not required. Typical practical temperatures for adding such a blend range from 20 deg. C. to 60 deg. C. A more preferred temperature is 20 deg. C. to 40 deg. C. Most preferred is 20 deg C. to 35 deg. C. The blend comprising APANA and one or more aromatic esters may be poured or pumped into the finished fluid, additive concentrate or additive package.

A liquid blend of APANA composed of one or more aromatic esters has additional benefits in finished lubricants. For example, the combination of APANA with one or more aromatic esters should improve solubility of other additives in additive packages and finished lubricants. Thus, the lubricating composition may comprise a lubricant base, a blend of APANA and aromatic amine, as well as one or more of antioxidants, corrosion inhibitors, rust inhibitors, anti-wear additives, organic friction modifiers and molybdenum-based friction modifiers.

DETAILED DESCRIPTION OF THE INVENTION

Figure 1:
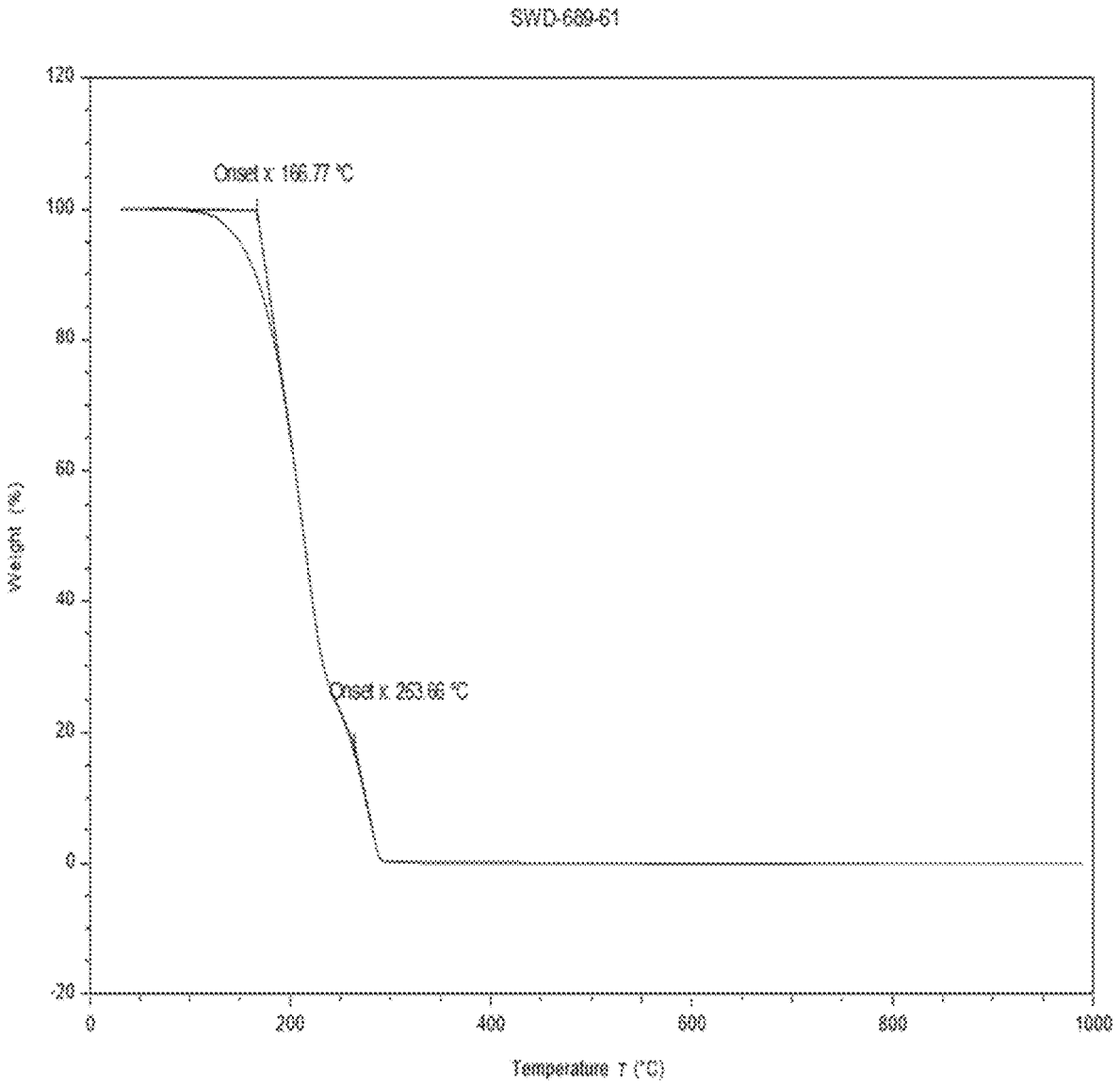
FIGS. 1-4 are line graphs depicting a thermogravimetric analysis of the liquid blend for determining mass loss with respect to temperature for benzyl benzoate and diethyl phthalate blended with octylated N-phenyl-α-naphthylamine at 30%.
Figure 2:
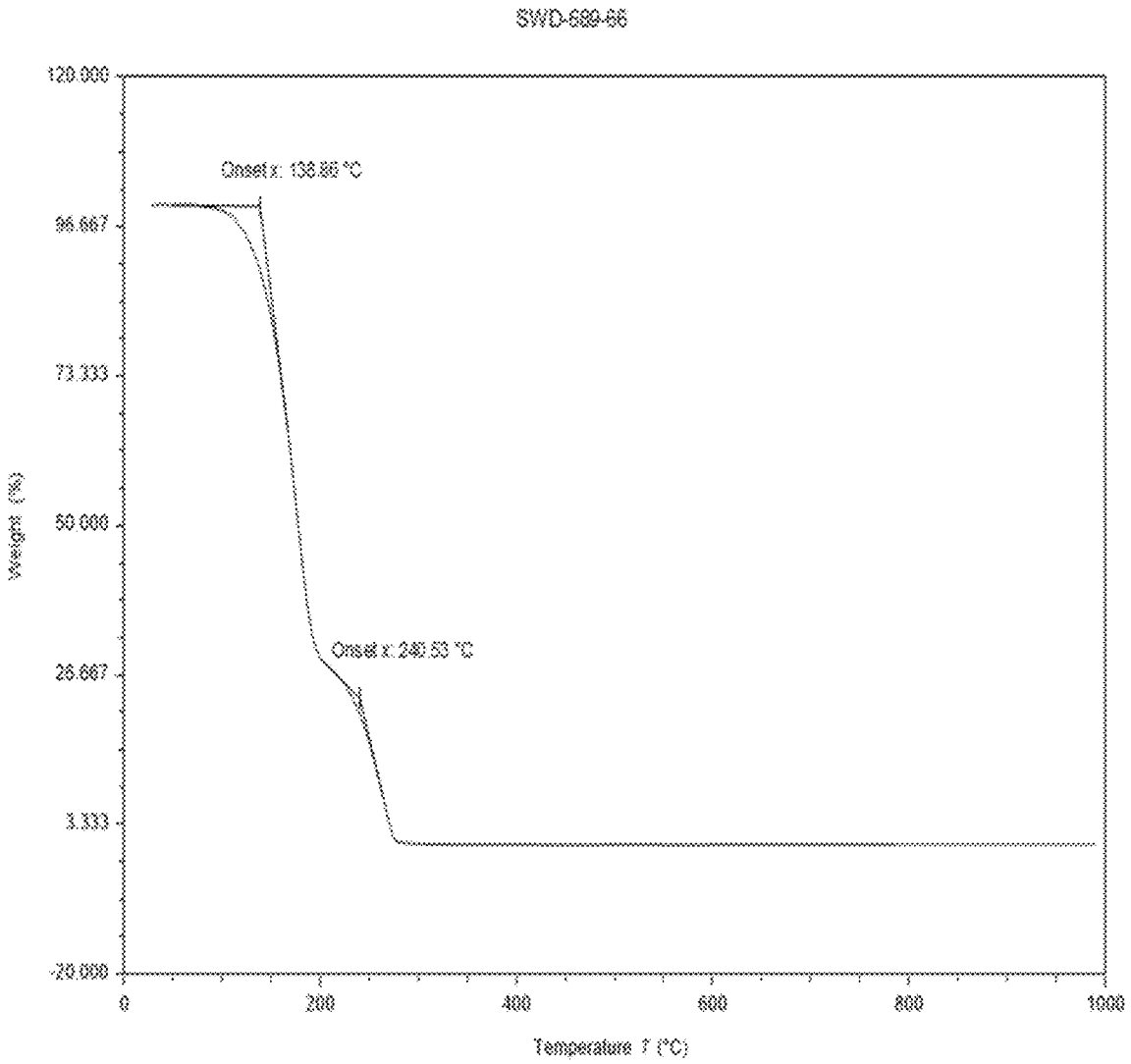
Figure 3:
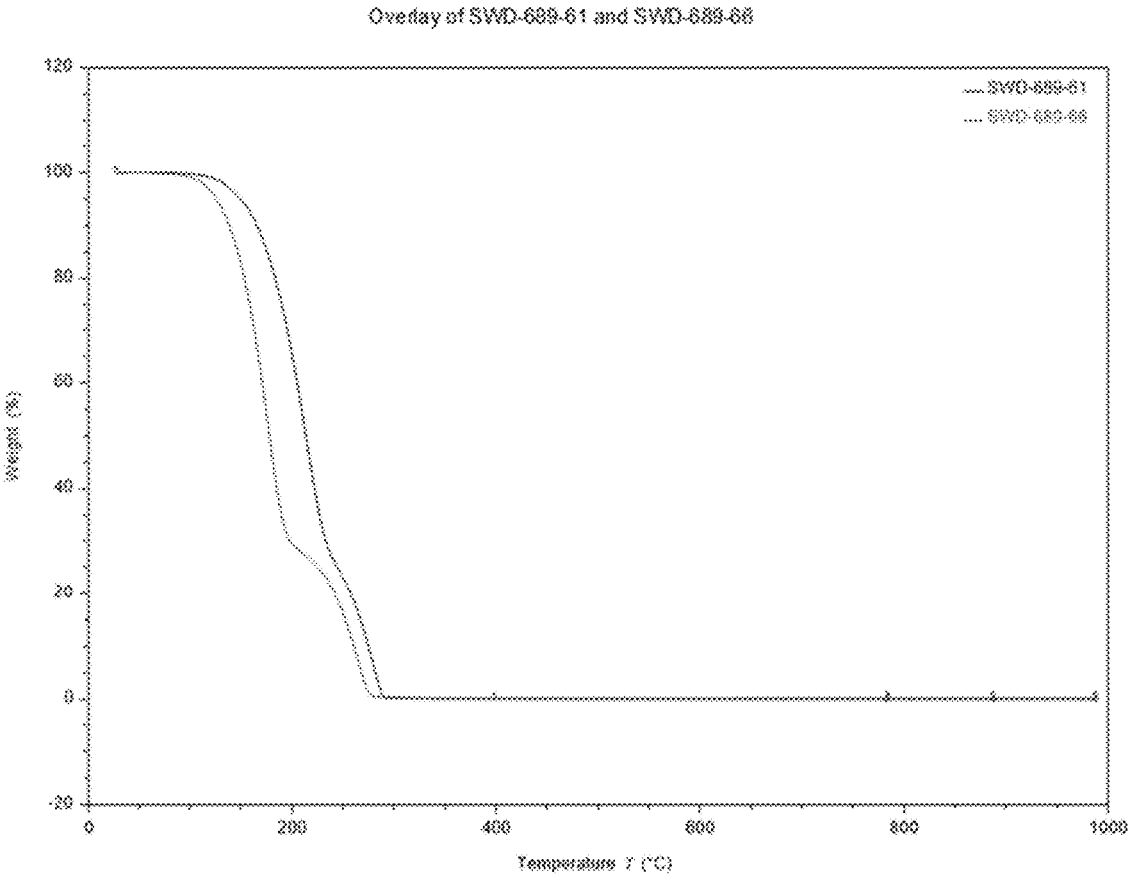
Figure 4:
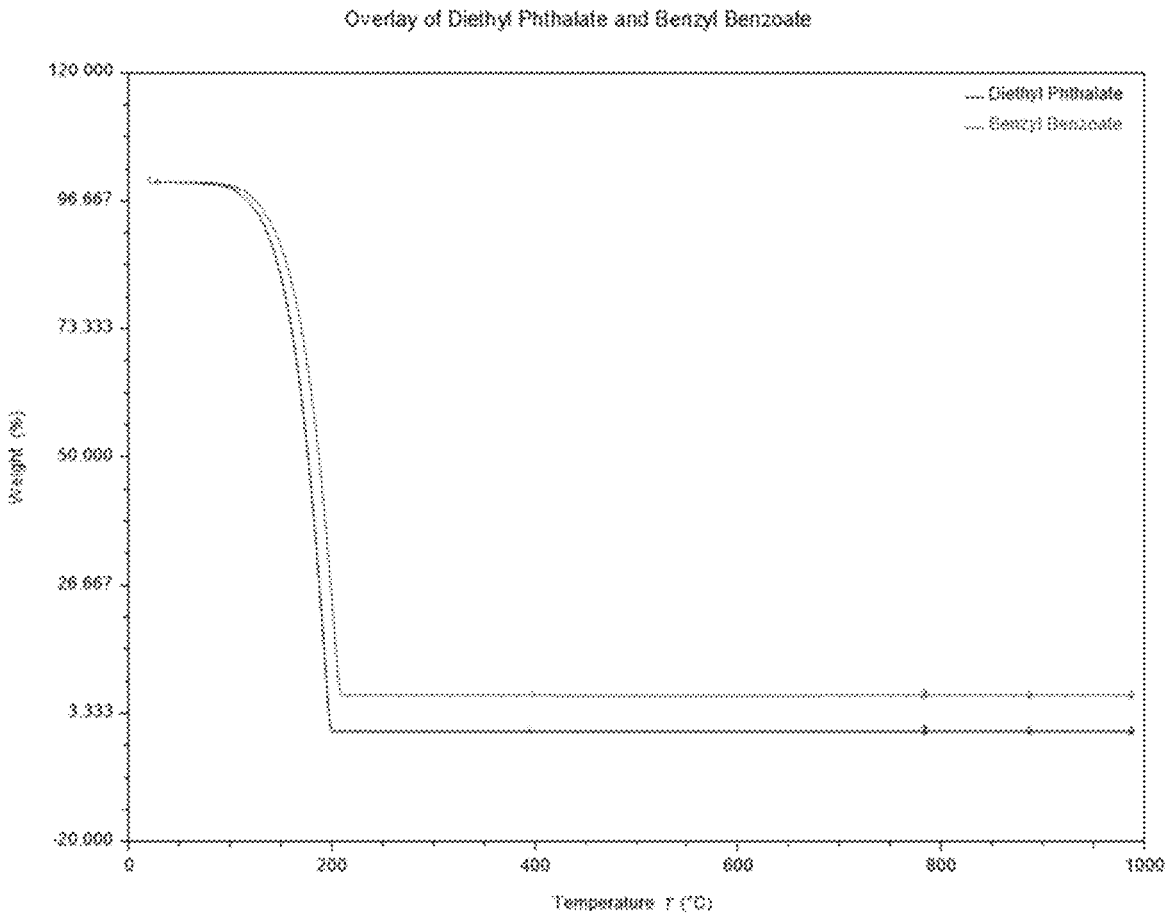

Octylated N-phenyl-α-naphthylamine (available as VANLUBE® 1202 antioxidant from Vanderbilt Chemicals, LLC of Norwalk, Conn.) is blended with a low molecular weight aromatic ester at about 20 degrees C. The esters are preferably benzyl benzoate, diethyl phthalate or a mixture of the two. However, it is expected that any of the aromatic esters listed earlier in the specification could be effective for the stated purpose, namely, providing a stable, liquid environment for octylated N-phenyl-α-naphthylamine. The amount of octylated N-phenyl-α-naphthylamine in the blend will range from about 15 to about 35 weight percent, preferably about 25-32 wt. %, more preferably about 28-32 wt. %, and most preferably about 30 wt. %.

The invention also relates to a lubricating composition comprising a lubricating base of at least 85% by weight, and a blend of APANA, preferably octylated N-phenyl-α-naphthylamine and aromatic ester in an amount which provides from about 0.01 to about 1.0% of APANA in the lubricating composition, preferably about 0.05 to about 0.2 weight %.

Test samples were prepared with VANLUBE® 1202 octylated N-phenyl-α-naphthylamine (also labeled as VL 1202 in the figures) at 30% and 40% by weight of the total octylated N-phenyl-α-naphthylamine/ester blend in diethyl phthalate. 30% octylated N-phenyl-α-naphthylamine in diethyl phthalate showed good storage stability after 46 days. 30% octylated N-phenyl-α-naphthylamine diethyl phthalate. 40% octylated N-phenyl-α-naphthylamine in diethyl phthalate showed crystal fallout after 13 days, suggesting that 40% octylated N-phenyl-α-naphthylamine is too high to achieve stability and therefore the acceptable limit is below 40%.

Liquid samples of 30% and 40% octylated N-phenyl-α-naphthylamine were made in 1:1 (by weight) benzyl benzoate:diethyl phthalate solvent mixture. 30% octylated N-phenyl-α-naphthylamine sample in 1:1 benzyl benzoate and diethyl phthalate showed good stability after 76 days. Table 1 below shows the results for the 30% and 40% blends in terms of stability.

TABLE 1

| Sample # | APANA | Diluent (s) | Stability (room temperature 18-25 C.) | Stability (dark - away from direct sun light) |
|---|---|---|---|---|
| SWD 689-66 | 30% | Diethyl phthalate | Clear after 113 days | |
| SWD 689-74 | 30% | Diethyl phthalate | | Clear after 98 days |
| SWD 689-67 | 40% | Diethyl phthalate | Crystals after 13 days | |

TABLE 1-continued

| Sample # | APANA | Diluent (s) | Stability (room temperature 18-25 C.) | Stability (dark - away from direct sun light) |
|---|---|---|---|---|
| SWD 689-72 | 30% | Benzyl benzoate and diethyl phthalate (1:1) | Clear after 98 days | |
| SWD 689-73 | 40% | Benzyl benzoate and diethyl phthalate (1:1) | Crystals after 12 days | |
| RTJ 683-113 | 30% | Benzyl benzoate *Reconstituted RTV | Clear after 70 days | |

*sample stored cold to simulate variable storage temperatures, then gently heated to redissolve. Room temperature stability was confirmed.

Sample RTJ 683-113 that was kept in a refrigerator showed crystal fall out. However, upon gently heating to 50 degrees C., the solid component dissolved completely and remained clear after 70 days at room temperature.

Table 2 below shows analytic analysis for the 30% octylated N-phenyl-α-naphthylamine (OPANA) blends

TABLE 2

| Property | SWD 689-61 (OCD-462) 30% OPANA in benzyl benzoate (BB) | SWD 689-66 (OCD-462B) 30% OPANA in diethyl phthalate (DEP) | SWD 689-72 30% OPANA in (1:1) BB and DEP |
|---|---|---|---|
| ASTM color | 5 | 3.5 | 4 |
| Density @20 C. | 1.092 | 1.092 | 1.092 |
| Flash Point C. (closed cup) | 167 | 156 | 160 |
| Viscosity at 40 C. cSt | 14.8 | 19 | 15.25 |
| Viscosity at 100 C. cSt | 1.1 | 2.4 | 0.877 |

TABLE 3

| SAMPLE | ONSET TEMP 1 (° C.) | ONSET TEMP 2 (° C.) |
|---|---|---|
| SWD-689-61 OCD-462, 30% OPANA in benzyl benzoate | 166.8 | 263.7 |
| SWD-689-66 OCD-462B, 30% OPANA in diethyl phthalate | 138.9 | 240.5 |
| Benzyl Benzoate | 154.1 | — |
| Diethyl phthalate | 147.1 | — |

With reference to FIGS. 1-4 and Table 3 above, a thermogravimetric analysis (TGA) was done to assess volatility, being measured in terms of weight loss to determine the onset temperature at which the blend becomes volatile. A higher onset temperature is preferable. TGA of SWD-689-61 (benzyl benzoate) sample showed better volatility compared to SWD-689-66 (diethyl phthalate).

Figure 5:
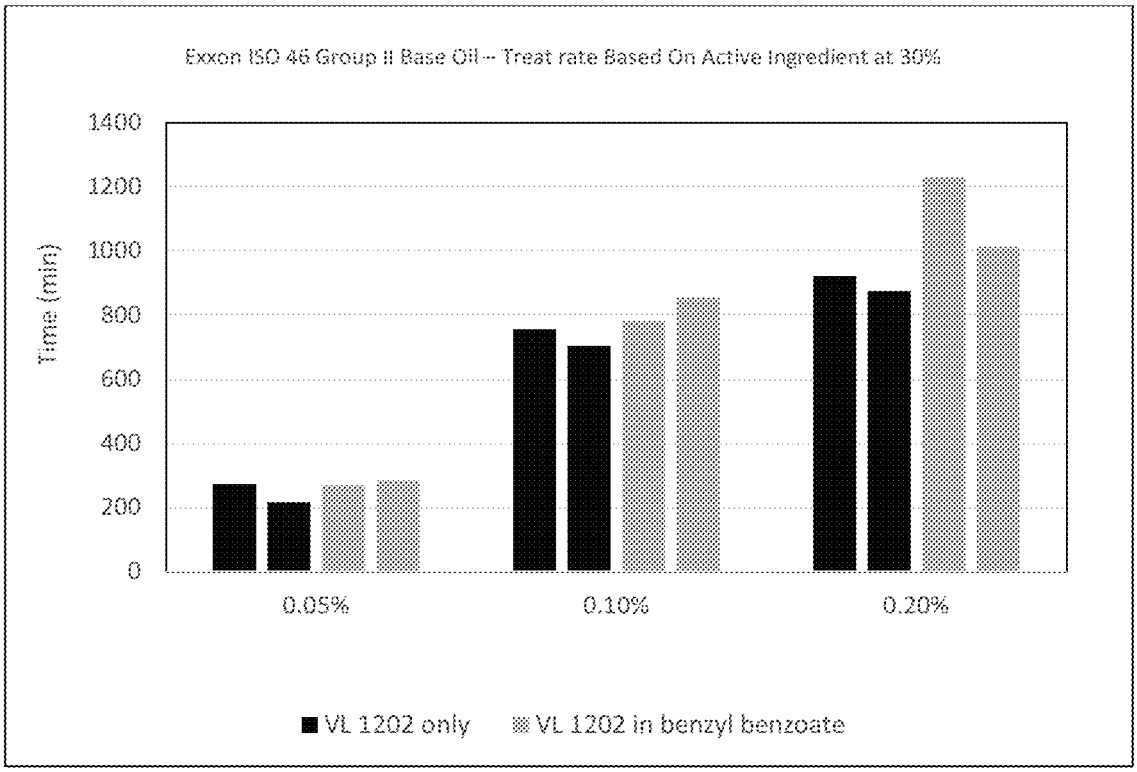
FIGS. 5-7 are bar graphs showing relative oxidation of a lubricating composition comprising a different base oils and the inventive blends of octylated N-phenyl-α-naphthylamine/benzyl benzoate and octylated N-phenyl-α-naphthylamine/diethyl phthalate.
Figure 6:
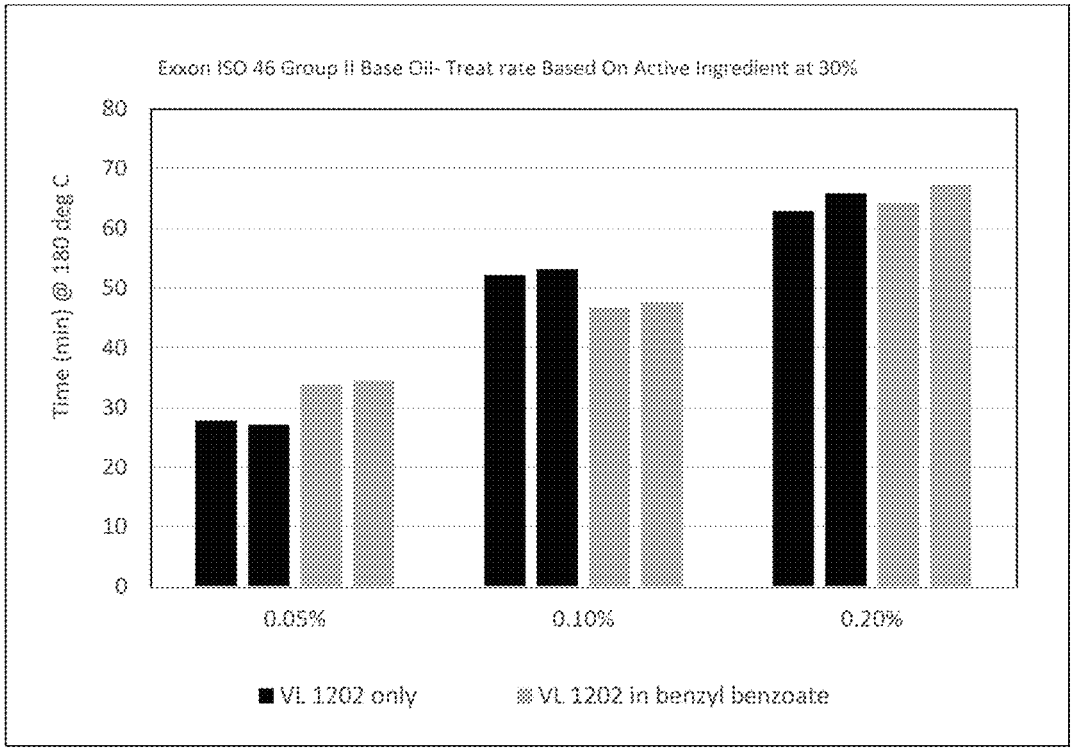
Figure 7:
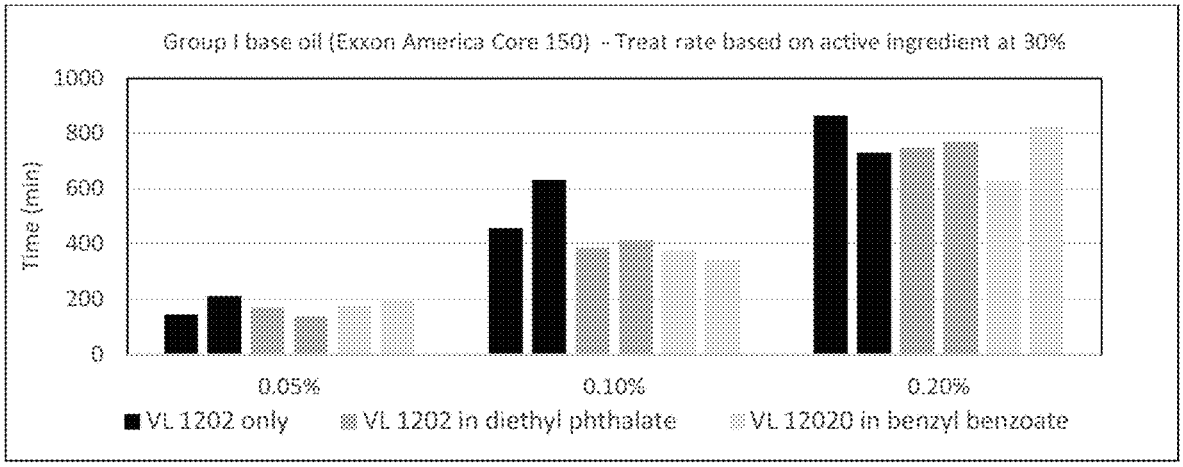

With reference to FIGS. 5-7, samples of the octylated N-phenyl-α-naphthylamine/benzyl benzoate and octylated N-phenyl-α-naphthylamine/diethyl phthalate (both at 30% octylated N-phenyl-α-naphthylamine within the blend) were added to Group I and II base oils at treat rates of 0.05, 0.1 and 0.2 weight % octylated N-phenyl-α-naphthylamine and were evaluated for antioxidant activity by means of RPVOT (The Rotating Pressure Vessel Oxidation Test) and PDSC (Pressure Differential Scanning calorimetry). These data demonstrate that blends of octylated N-phenyl-α-naphthylamine/aromatic esters are within a range of acceptance in terms of antioxidant protection when compared to using octylated N-phenyl-α-naphthylamine on its own. However, given the ease of handling the inventive blend compared to the solid octylated N-phenyl-α-naphthylamine demonstrates that the blend is an advantageous substitute for solid octylated N-phenyl-α-naphthylamine.

What is claimed is:

1. A liquid blend consisting of octylated phenyl-α-naphthylamine, and at least one low molecular weight aromatic ester, wherein the octylated phenyl-α-naphthylamine is present from about 15% to about 35% by weight of the blend, wherein the aromatic ester is chosen as one or more in combination of tris-methyl trimellitate, tris-ethyl trimellitate, tris-propyl trimellitate, tris-butyl trimellitate, tris-2-ethylhexyl trimellitate, tris-isooctyl trimellitate, tris-2-ethylhexyl trimellitate, tris-n-octyl trimellitate, tris-isononyl trimellitate, tris-isodecyl trimellitate, diethyl phthalate, dipropyl phthalate, dibutyl phthalate, di-2-ethylhexyl phthalate, diisooctyl phthalate, di-n-octyl phthalate, diisononyl phthalate, diisodecyl phthalate, diethyl isophthalate, dipropyl isophthalate, dibutyl isophthalate, di-2-ethylhexyl isophthalate, diisooctyl isophthalate, di-n-octyl isophthalate, diisononyl isophthalate, diisodecyl isophthalate, diethyl terephthalate, dipropyl terephthalate, dibutyl terephthalate, di-2-ethylhexyl terephthalate, diisooctyl terephthalate, di-n-octyl terephthalate, diisononyl terephthalate, diisodecyl terephthalate, 2-ethylhexyl benzoate, isooctyl benzoate, n-octyl benzoate, isodecyl benzoate, methyl trans-cinnamate, and benzyl benzoate.

2. The blend of claim 1, wherein the octylated phenyl-α-naphthylamine is present from about 25% to about 32% by weight of the blend.

3. The blend of claim 2, wherein the octylated phenyl-α-naphthylamine is present at about 30% by weight of the blend.

4. The blend of claim 1, wherein the aromatic ester is chosen from benzyl benzoate, diethyl phthalate and a combination thereof.

5. The blend of claim 2, wherein the aromatic ester is chosen from benzyl benzoate, diethyl phthalate and a combination thereof.

6. The blend of claim 3, wherein the aromatic ester is chosen from benzyl benzoate, diethyl phthalate and a combination thereof.

* * * * *